US005338148A

United States Patent [19]

Rönnblom

[11] Patent Number: 5,338,148

[45] Date of Patent: Aug. 16, 1994

[54] LATERALLY MOVABLE FORK ARRANGEMENT ATTACHED TO A WORKING MACHINE

[75] Inventor: Ahrne Rönnblom, Skelleftea, Sweden

[73] Assignee: Stalteknik I Skelleftea AB, Skelleftea, Sweden

[21] Appl. No.: 856,917

[22] PCT Filed: Nov. 8, 1990

[86] PCT No.: PCT/SE90/00725

§ 371 Date: May 12, 1992

§ 102(e) Date: May 12, 1992

[87] PCT Pub. No.: WO91/07345

PCT Pub. Date: May 30, 1991

[30] Foreign Application Priority Data

Nov. 21, 1989 [SE] Sweden ..... 8903904

[51] Int. Cl.[5] ..... B66F 9/14

[52] U.S. Cl. ..... 414/667; 414/723

[58] Field of Search ..... 414/667, 723, 671, 664, 414/668, 607, 608; 901/28, 29

[56] References Cited

U.S. PATENT DOCUMENTS

| | | | |
|---|---|---|---|
| 2,360,407 | 10/1944 | Dunham et al. | 414/667 |
| 2,663,443 | 12/1953 | Schenkelberger | 414/667 |
| 4,144,981 | 3/1979 | Borgen | 414/607 |
| 4,381,166 | 4/1983 | Smart | 414/667 X |
| 4,630,855 | 12/1986 | Bjurling | 294/81.21 |
| 4,636,135 | 1/1987 | Bancon | 901/28 X |
| 4,688,982 | 8/1987 | Smart | 414/667 |
| 4,756,661 | 7/1988 | Smart | 414/667 |
| 4,766,775 | 8/1988 | Hodge | 901/28 X |
| 4,815,780 | 3/1989 | Obrist | 901/28 X |
| 4,955,779 | 9/1990 | Knackstedt | 414/723 |
| 4,990,022 | 2/1991 | Watanabe et al. | 901/28 X |

FOREIGN PATENT DOCUMENTS

| | | | |
|---|---|---|---|
| 2410463 | 10/1974 | Fed. Rep. of Germany | 414/667 |
| 3702703 | 8/1988 | Fed. Rep. of Germany | 414/667 |

*Primary Examiner*—Michael S. Huppert
*Assistant Examiner*—James T. Eller, Jr.
*Attorney, Agent, or Firm*—Cushman Darby & Cushman

[57] ABSTRACT

A working machine is frontally provided with a structure for removably supporting an implement. The implement which is removably supported is a frame which transversely shiftably mounts two forwardly projecting lifting tines. An electrically powered adjusting device mounts the lifting tines to the frame. An electrical cable which provides electrical service from the working machine to the adjusting device includes a two-part connector the parts of which are automatically plugged together and separated as the frame is mounted to and demounted from the working machine. A locking device is provided for mechanically fixing a selected position to which the lifting tines have been adjusted.

6 Claims, 3 Drawing Sheets

LATERALLY MOVABLE FORK ARRANGEMENT ATTACHED TO A WORKING MACHINE

BACKGROUND OF THE INVENTION

The present invention relates to an arrangement pertaining to a working implement having the form, for instance, of a fork-frame structure which is provided with one or more, preferably at least two lifting forks or tines, each of which is suspended on a respective lifting frame in a manner which will enable the lifting forks to be moved laterally.

It is known to move forks that are suspended on a fork arm with the aid of hydraulically operated screw-nut devices, for instance of the kind described in WO-A1-88/00894, or with the aid of double-acting hydraulic piston-cylinder devices. These known devices for lateral movement of the lifting forks are highly-complicated, however, and therewith expensive to provide and also require the provision of a hydraulic power source in order to perform their functions.

This type of working implement requires the provision of devices by means of which the working implement can be coupled automatically to the implement attachment means on the working machine, and also with devices by means of which the working implement can be connected to the machine, which includes automatic hose connections for connecting the working implement hydraulically to the hydraulic system of the working machine, so as to enable hydraulically operated functions incorporated in the working implement to be activated directly from the driving cabin of the working machine. These latter types of automatic couplings are also constructed so as to enable a working implement to be coupled to the machine without the driver needing to leave the driver's cabin or to employ the help of an assistant. Despite this, however, it is found that known coupling devices of this kind do not fulfill the aforesaid conditions and are also encumbered with the troublesome drawback that when connecting and disconnecting the quick-couplings of the hydraulic hoses some hydraulic oil is always spilled onto the ground. Although various methods of preventing this have been proposed in the art, none has been successful to any great extent.

Furthermore, when disconnected, such automatic hose couplings are totally exposed and unprotected and therefore subjected to dust, sand, dirt and the like, which, due to the presence of oil on the disconnected quick-connection halves, readily fastens to the couplings and is liable to destroy the hose couplings totally. As a result of this, a parallel problem is one of providing a well functioning automatic coupling device for a working implement which requires access to an energy source of the working machine in order to carry out its function.

SUMMARY OF THE INVENTION

A prime object of the present invention is to provide a simple arrangement for moving laterally the lifting forks of both tractor-carried lifting-fork implements and fork trucks in order to adjust the spacing between the forks.

A further object of the invention is to provide tractors in particular and also other machines of the kind mentioned in the introduction with an arrangement or device which will enable a working implement in the form of a fork-frame structure which carries lifting forks to be coupled to an implement attachment means carried by arms on a working machine, in a manner such that the motor required for moving the lifting forks is connected automatically to its drive source without the occurrence of oil spillage.

BRIEF DESCRIPTION OF THE DRAWINGS

The invention will now be described in more detail with reference to the accompanying drawings in which.

DETAILED DESCRIPTION

Figures 1, 2:
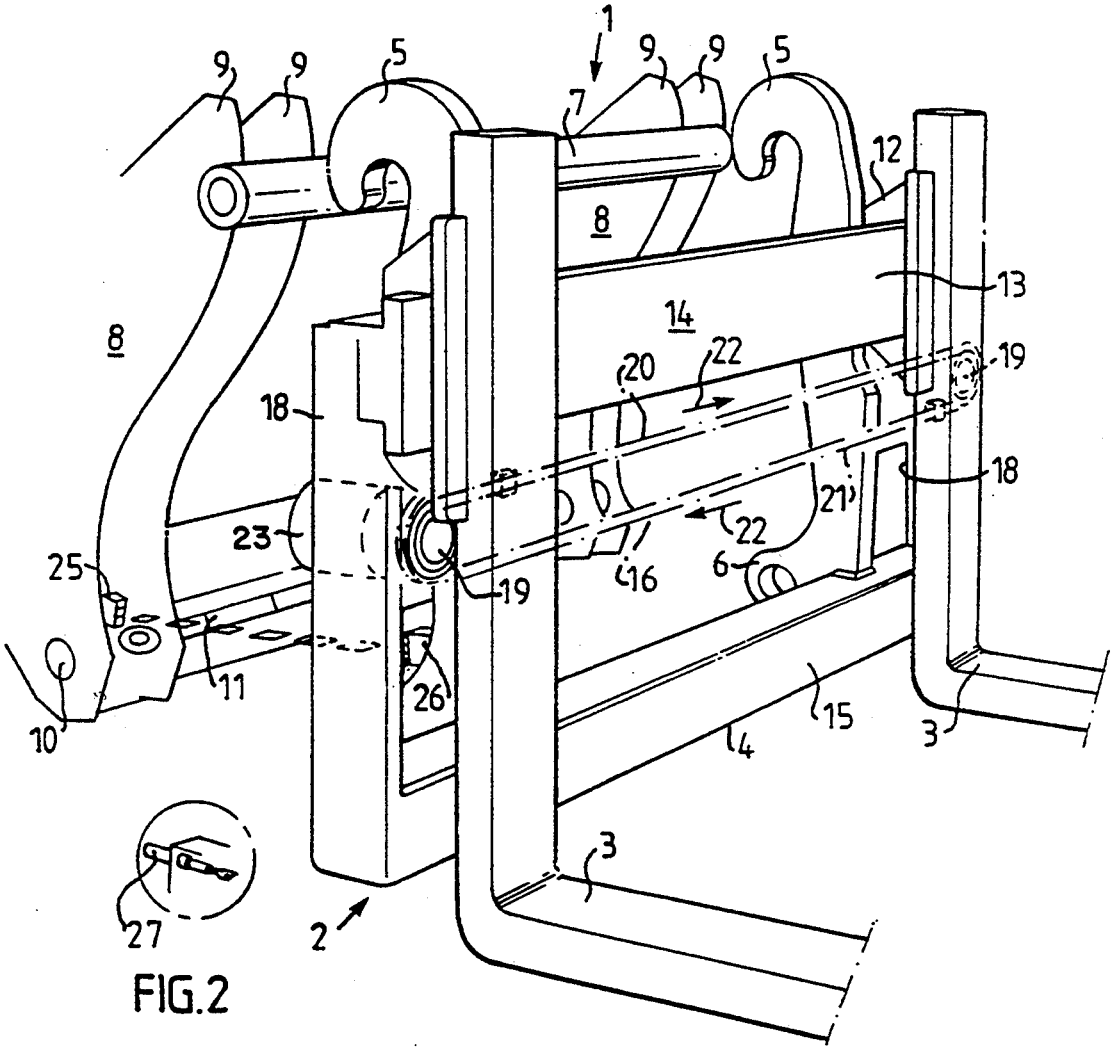
FIG. 1 illustrates in perspective an exemplifying embodiment of the inventive arrangement in an operational state immediately prior to coupling the working implement to the arm-carried implement attachment means of a working machine.
FIG. 2 is an enlarged view of part of the inventive arrangement shown in FIG. 1.

In FIG. 1 the reference numeral 1 identifies generally an implement attachment means which is carried on one end of the operating arm or implement arm of a working machine, not shown in detail in the Figure. The reference numeral 2 identifies a working implement or tool in the form of a fork-frame structure 4 provided with lifting forks 3 and also with attachment means in the form of attachment hooks 5 and two attachment lugs 6 in which holes are provided, the attachment means being adapted to the implement attachment means. The implement attachment means 1 can be manouvered from the machine driving cabin and includes on one side a transversally extending, preferably round carrier rod 7 which is attached to the side members 8 of the attachment means, each side member including two mutually separated plates 9. The spacing between the plates is greater than the thickness of the implement attachment hooks 5. Each of the side-pieces 8 of the instrument attachment means is provided on its lower part with locking holes 10 which accommodate hydraulically or mechanically operable locking pins 11 which function to lock and positionally fixate the attachment lugs 6 on the fork-frame structure to the implement attachment means 1. When coupling the implement 2 to the implement attachment means 1, the rod 7 of the manouverable implement attachment is moved, in a known manner, from beneath into the hooks 5 on the implement and the implement attachment means 1 is then swung around its rod 7, on which the actual implement is now suspended through the intermediary of its hooks 5, in towards the attachment lugs 6 on the implement. With the lugs positioned in line with respective locking holes 10 on the implement attachment means, the movable locking pins 11 are moved to a position in which the lugs 6 are locked to the attachment means 1, whereupon the implement is held immovably hanging from the implement attachment means 1 of the machine.

The fork-frame structure 4 includes a pair of lifting forks 3 which, with the aid of slide hooks 12, are displaceably suspended, in a known manner, on a transverse slide bar 13 included in the fork-frame structure 4. The lifting forks 3 slideably abut one side 14 of the slide bar 13 and are also slideably supported against the lower, transverse bar 15 of the fork-frame structure.

In accordance with the present invention, one and/or the other of the lifting forks 3 is connected to, or capable of being connected to a movement transmission device 16 which functions to move the forks laterally and therewith adjust the spacing between the forks, this spacing being adapted to the size of the object or objects to be handled. In the case of the embodiment illustrated in FIG. 1, both of the lifting forks 3 are connected to a movement transmission device 16.

Figure 4:
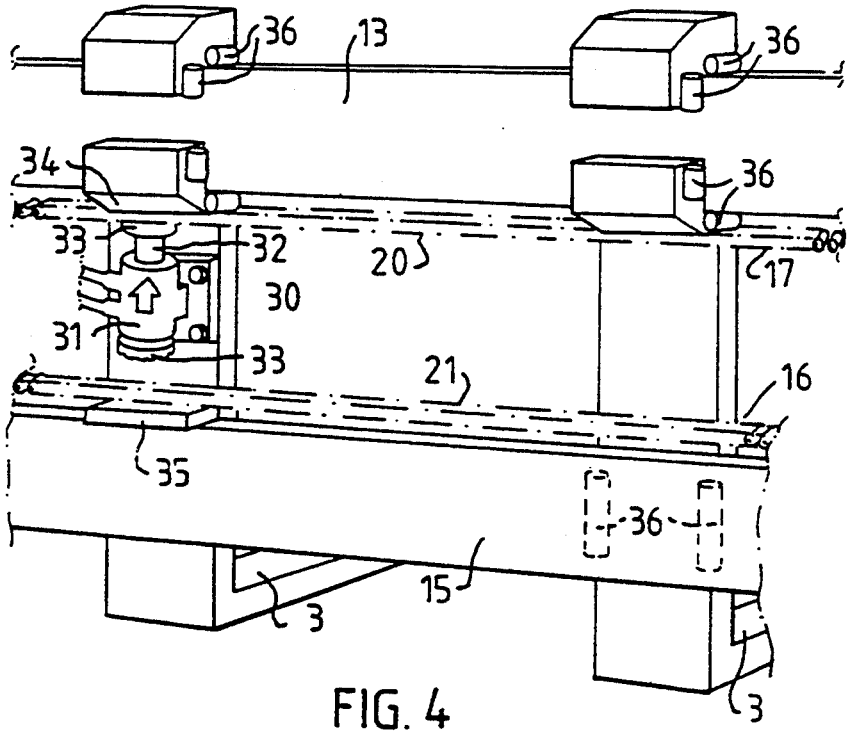
FIG. 4 is a perspective view in larger scale seen from the rear side of the implement and illustrates a locking means for parallel outward/inward movement of the forks of the implement.
Figure 6:
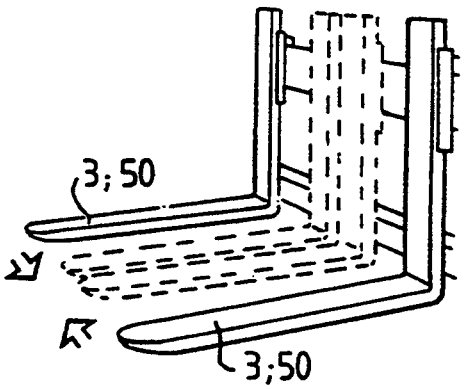
FIGS. 5 and 6 illustrate schematically said parallel inward/outward movement of the forks.
Figure 5:
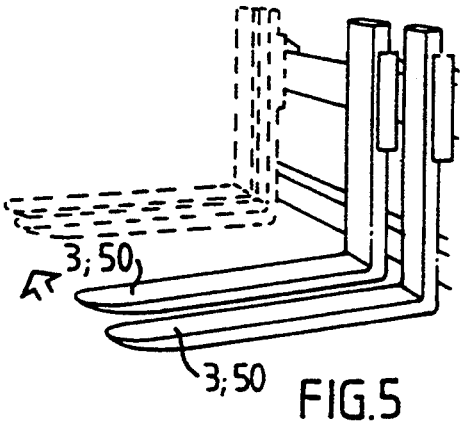

The movement transmission device 16 of the illustrated embodiments has the form of an endless chain 17 which runs over sprocket wheels 19 mounted on the short sides 18 of the fork-frame structure, of which sprocket wheels at least one is driven, in use. In case only one of the sprocket wheels is driven, the case the other accompanies the movement of the driven wheel. In the case of the FIG. 1 embodiment, the upper part or run 20 of the endless movement transmission device 16 or the chain 17 is connected to one of the lifting forks 3, whereas the lower part or run 21 of the device or chain is connected to the other lifting fork 3, such that when the device 16 is driven in the direction shown by the arrows 22 both of said forks 3 will be moved towards one another, whereas movement of the device 16 in the opposite direction will cause the forks 3 to move apart. The connection between chain and fork may either be a fixed connection, e.g. a bolt connection, or a detachable connection, e.g. an electromagnet connection, thereby enabling one fork 3 to be moved independently of the other. FIGS. 4–6 illustrate a locking means 30 which, in accordance with the present invention, may be operable hydraulically, pneumatically or electrically when concerned with fork-lift trucks, although in principle solely electrical operation is applicable in the case of tractor-carried fork implements. The locking means 30 is mounted on the back of the fork, between the slide bar 13 of the fork-frame structure and the lower transverse frame-beam 15. In the illustrated case, the locking means has the form of a double-acting piston-cylinder device 31 having a two-sided or through-passing piston rod 32 which is provided at each end with a locking plate 33. In the neutral position or non-locking position of the locking means, the locking plates 33 are located between the two parts or runs 20 and 21 of the endless chain, so as to enable the plates to be moved to an upper locking position, as illustrated in FIG. 4, in which they clamp the upper run 20 of the endless chain firmly against an anvil surface or counter-pressure surface 34 on the fork 3 concerned, or to a lower end position in which they clamp the bottom run 21 of the endless chain against a lower anvil surface or counter-pressure surface 35 on the fork concerned.

In the case of the FIG. 4 embodiment, the upper run 20 of the endless chain is also firmly connected to that fork which does not carry the locking means 30 and with the locking means 30 in its upper locking position. Thus in the position in which the upper run 20 of the chain is connected to both of the forks 3, the forks will be moved in parallel, as illustrated in FIG. 5, whereas with the locking means 30 in its lower locking position, in which the bottom run 21 of the chain is connected to that fork 3 which is provided with the locking device, both forks will be moved in towards one another, or away from one another, depending on the direction of chain movement, and thus in the same manner as that described with reference to the FIG. 1 embodiment. Thus, when the locking means 30 is located in its neutral position, the fork 3 which is firmly connected to the chain 17 can-be moved relative to the other fork, which is therewith stationary, so as to also enable the distance between the forks to be changed.

For the purpose of facilitating lateral movement of the forks 3 even when they carry load, rollers 36 are mounted at an angle between the forks 3 and the long sides of the slide beam 13, and also between the forks and the long side of the beam 15 facing towards the forks, as illustrated schematically in FIG. 4.

In the case of the exemplifying embodiments of the invention illustrated in the drawings, the movement transmission device 16 is driven by an electric motor 23 (FIG. 1) the output drive shaft of which carries the driven sprocket wheel 19. Electric current is supplied to the motor through a two-part pin contact or electrical connector, one part 25 of which, e.g. the pin part or outtake part, is connected to the implement attachment means 1, and the other part 26, e.g. the socket or intake part, is connected to the lifting arm 4, such that these two connector parts are brought into contact with one another automatically when applying the lifting frame 4 to the implement attachment means 1. As illustrated in FIG. 2, the pins 27 on the connector plug are spring biased, so that the pins will be held constantly against an electrical contact plate or tab in the connected state of the current supply device, this contact plate being provided in the part referenced 25 in the FIG. 1 embodiment.

Figure 3:
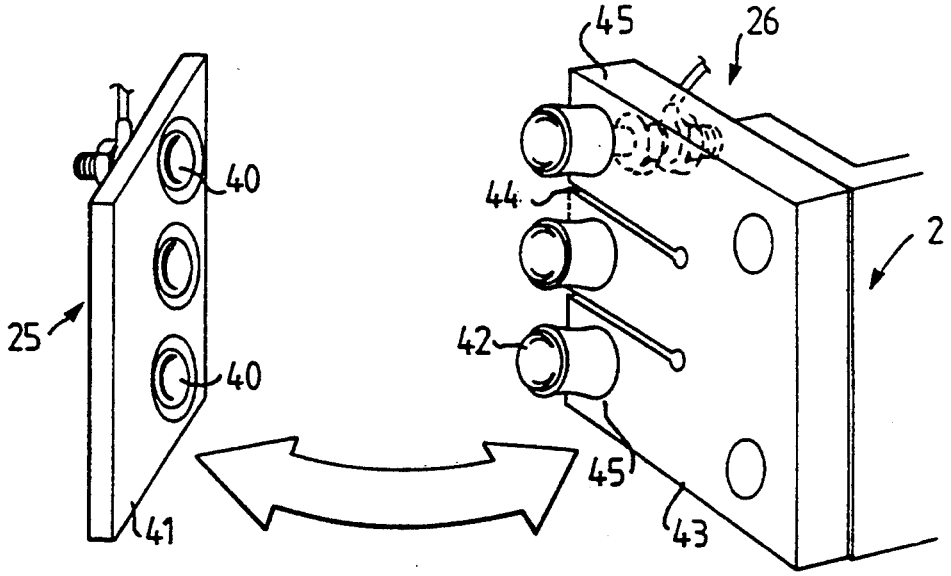
FIG. 3 illustrates in larger scale an electric contact device forming part of the inventive arrangement.

A preferred embodiment of an electrical connector device of the present invention is illustrated in FIG. 3. The socket-outlet 25 of this device, i.e. that part of the device which is located on the current supply side, is mounted on the implement attachment means of the tractor and includes a plurality of electrical contact plates 40 which are fixed in mutually spaced relationship in a body 41 made of an electrically insulating material, preferably rubber or some corresponding material, and the intake part 26 of which, i.e. that part of the electrical connector device which is located on the consumer side, is joined to the implement 2 and includes a number of connector pins 42 which correspond in number to the number of the electrical contact plates 40 and which are fixed mutually spaced in a body 43 made of an electrically insulating material, preferably rubber or some corresponding material. The body 43 has formed therein, between respective connector pins 42, a through-passing slot 44 such as to form fingers 45, each of which carries a connector pin 42 and which, due to the nature of the material used, are resilient. By allowing the fingers 45 of the connector pins to be urged rearwardly when coupling together the plug and socket connection 25, 26 and also, optionally, the rubber body 41 carrying the electrical contact plates 40, when the electrical connection is established the electric contact plates 40 and the connecting pins 42 will be held positively in mutual abutment by the rearwardly bent fingers 45 and, when applicable, by the elastic restoring force exerted by the body 41 of the electrical intake part of the connection. By constructing at least the outtake part 25 of the electrical contact device, and preferably also its intake part 26 of rubber or some corresponding material, there is obtained an electrical connector device which is very robust and operationally reliable in the present context.

Figure 7:
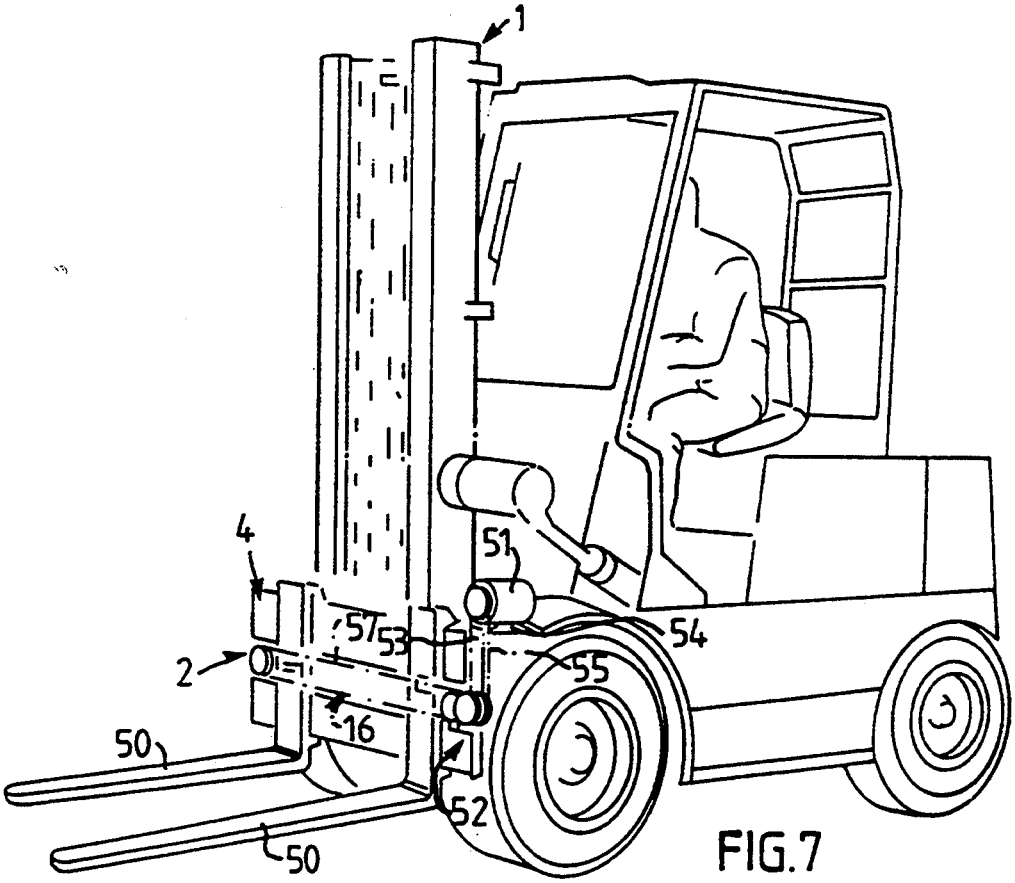
FIG. 7, finally, is a perspective view of one embodiment of the present invention applied to a fork lift truck.

FIG. 7 illustrates the present invention as applied to a fork-lift truck, the lifting forks or tines 50 of which can be moved with the aid of the endless movement transmission device 16, of the present invention which also in this case has the form of an endless belt 57 driven by a motor 51. When the working implement forms an integral part of the machine, i.e. of the truck in the illustrated case, the motor may be a hydraulic motor or some other suitable motor, such as a pneumatic or electric motor, and is mounted on a carrier plate 54 attached to the upper part 53 of the raisable and lowerable fork-frame structure 52, so as to accompany the frame structure 52 as it moves up and down. In the case of the FIG. 7 embodiment, the motor 51 is connected to one end wheel 19 of the movement transmission device through the intermediary of a chain transmission 55, which includes a chain, a sprocket wheel mounted on the output shaft of the motor 51 and a further sprocket wheel mounted on the same shaft, although when the movement transmission device 16 has the form of an endless chain, the chain can be extended so as to pass from one chain end wheel and over a drive wheel mounted on the output drive-shaft of the motor 51 and back via a guide wheel (not shown) which imparts the intended, illustrated extension to the upper run 20 of the chain.

It will be understood that the present invention is not restricted to the aforedescribed and illustrated embodiments, but that these embodiments can be changed, modified and complemented in many different ways within the scope of the inventive concept defined in the following claims. For instance, the movement transmission device 16 may have the form of a V-belt, a wire, a toothed belt or some corresponding device, since movement of the two lifting forks towards and away from one another does not need the application of large forces. Furthermore, each lifting fork may be mounted on a motor and a movement transmission device, and it may also be convenient to provide each lifting fork with a locking device 30, therewith obviating the need to provide a fixed or stationary connection between the movement transmission device 16 and the one and/or the other fork.

I claim:

1. Apparatus, comprising:

a working machine having an implement attaching means;

a transversely extending fork frame structure removably supported on said working machine via said implement attaching means;

two lifting forks movably supported on said fork frame structure beside one another for movement transversely of said working machine;

a movement transmission device comprising an endless flexible element extending transversely of said working machine and entrained at transversely opposite ends of said device about respective rotatable members, so as to have an upper run and a lower run, said rotatable members being mounted to said fork frame structure;

a reversibly operable electric motor-powered drive effectively connected to said movement transmission device, and operable for reversely running said endless flexible element;

a first connector selectively connecting one of said lifting fork to one of said runs of said endless flexible element for movement therewith transversely of said working machine and a second connector selectively connecting the other of said lifting forks to the other of said runs of said endless flexible element for movement therewith transversely of said working machine, so that operation of said electric motor-powered drive in one direction moves said lifting forks effectively closer to one another and operation of said electric motor-powered drive in an opposite direction moves said lifting forks effectively further from one another;

a source of electrical power provided on said working machine;

an electric power cable arranged for effectively connecting said source of electric power with reversibly operable electric motor-powered drive when said fork frame structure is supported on said working machine via said implement attaching means;

said electric power cable having incorporated therein a two-part electrical connector including a first part mounted to said implement attaching means and a second part mounted to said fork frame structure, so as to establish an electrical connection therebetween as a consequence of said fork frame structure becoming supported on said implement attaching means and so as to break electrical connection therebetween as a consequence of said fork frame structure becoming removed from support on said implement attaching means; and a remotely controlled locking means mounted to said one of said lifting forks for selectively operating said first connector to selectively fix a portion of either of said runs to said one of said lifting forks for effectively permitting transverse movement of said lifting forks relative to one another in a first locked position thereof where said forks are connected to opposite runs, and for permitting transverse movement of said lifting forks together with one another in a second locked position thereof where said forks are connected to the same run.

2. The apparatus of claim 1, wherein:

said lifting forks have respective tines which project forwardly relative to said working machine; said lifting forks have backs facing said working machine; each said remotely controlled locking means is mounted on a respective one of said backs; said fork frame structure includes an upper transverse element, a lower transverse element, and left and right upright elements connecting respective ends of said upper and lower transverse elements; and said locking means is arranged to trap the respective one of said runs against a portion of said back of said lifting fork when in one of said locked positions thereof.

3. The apparatus of claim 2, wherein:

said rotatable members are mounted on respective ones of said upright elements of said fork frame structure.

4. The apparatus of claim 1, wherein:

each of said two lifting forks including a remotely controlled locking means.

5. The apparatus of claim 1, wherein:

said first and second connectors are arranged to be selectively released so as to effectively disconnect said lifting forks from respective runs of said endless flexible element.

6. The apparatus of claim 1, wherein:

one of said parts of said two-part electrical connector is resiliently mounted by resilient means to the respective one of said implement attaching means or said fork frame structure, for resiliently biasing said first and second parts together as said electrical connection is established.

* * * * *